US011142921B2

(12) United States Patent
Hile

(10) Patent No.: US 11,142,921 B2
(45) Date of Patent: Oct. 12, 2021

(54) MOLDING REMOVAL TOOL ASSEMBLY

(71) Applicant: JBH Innovations, Inc., Wexford, PA (US)

(72) Inventor: Jeffrey B. Hile, Wexfotd, PA (US)

(73) Assignee: JBH INNOVATIONS, INC., Wexford, PA (US)

( * ) Notice: Subject to any disclaimer, the term of this patent is extended or adjusted under 35 U.S.C. 154(b) by 194 days.

(21) Appl. No.: 16/708,694

(22) Filed: Dec. 10, 2019

(65) Prior Publication Data

US 2020/0370317 A1 Nov. 26, 2020

Related U.S. Application Data

(60) Provisional application No. 62/850,630, filed on May 21, 2019.

(51) Int. Cl.

| | |
|---|---|
| ***B66F 15/00*** | (2006.01) |
| ***E04G 23/08*** | (2006.01) |
| ***B25C 11/00*** | (2006.01) |

(52) U.S. Cl.

CPC ..... *E04G 23/08* (2013.01); *B25C 11/00* (2013.01); *B66F 15/00* (2013.01); *E04G 2023/085* (2013.01)

(58) Field of Classification Search

CPC ..... B66F 15/00; B25B 27/00

See application file for complete search history.

(56) References Cited

U.S. PATENT DOCUMENTS

| | | | | |
|---|---|---|---|---|
| 1,167,574 | A * | 1/1916 | Lechner | B25C 11/00 254/25 |
| 4,663,995 | A * | 5/1987 | Amundson | B25B 27/00 254/131.5 |
| 10,793,410 | B2 * | 10/2020 | Liou | B65G 7/02 |
| 2017/0144876 | A1 * | 5/2017 | Kasan | E04G 23/08 |
| 2020/0002145 | A1 * | 1/2020 | Liou | B66F 15/00 |
| 2020/0370317 | A1 * | 11/2020 | Hile | E04G 23/08 |

* cited by examiner

*Primary Examiner* — Lee D Wilson

(74) *Attorney, Agent, or Firm* — Carothers and Carothers

(57) ABSTRACT

A molding removal tool assembly for prying molding off of a wall surface without damaging the molding or the wall surface. A pry bar is provided at its proximal end with a pry bar plate that extends at an angle from the pry bar and a striker shoe plate is secured with a hinge to the pry bar at and aligned with an edge of hinge securement of the pry bar plate to the pry bar. The striker shoe plate is provided with a cutout portion that receives the pry bar plate therein whereby the pry bar plate and striker plate are substantially flush with each other in a common plane when the pry bar plate is fully received in this cutout portion of the striker shoe plate. The striker shoe plate is provided with an exposed striker edge for receiving hammer blows in order to simultaneously wedge the flush striker shoe and pry bar plates between a wall surface and a molding attached to the wall surface. Once embedded, the pry bar is rotated to pry the molding away from the wall surface.

6 Claims, 5 Drawing Sheets

MOLDING REMOVAL TOOL ASSEMBLY

CROSS REFERENCE

This application claims the benefit of U.S. Provisional Patent Application No. 62/850,630, filed on 21 May 2019, for MOLDING REMOVAL TOOL.

BACKGROUND OF THE INVENTION

This invention relates to trim removal tools and more particularly pertains to a new trim removal tool for assisting a person in removing molding, including wall trim, door trim and baseboards, from a wall surface without damaging the trim or the wall surface.

Trim removal is presently accomplished by the use of a common pry bar or a special molding removal tool such as illustrated in U.S. Pat. No. 8,365,378. However, these prior art tools can cause damage to the wall surface and also to the molding being removed, generally causing the molding to split so that it is not reusable.

SUMMARY OF THE INVENTION

It is an object of the present invention to provide a high strength, stamped steel pry bar that eliminates damage to molding and delicate wall surfaces when removing the molding. The molding removal tool assembly of the present invention has the ability to distribute force evenly over an area and provides a striking shoe with a chisel-like edge for easy insertion behind the molding enabling the pry bar to slide into position behind the molding.

The molding removal tool assembly of the present invention is configured to assist a person in plying molding off of a wall surface without damaging the wall surface or molding. The molding removal tool assembly includes a pry bar with a handle at a proximal end thereof and a pry bar plate secured to the pry bar at a distal end thereof. The pry bar plate extends from the pry bar at an angle therefrom, which is generally a right angle but may be more or less than a right angle. A striker shoe having a striker shoe plate is secured with a hinge to the pry bar at and aligned width an edge of hinge securement of the pry bar plate to the pry bar. The striker shoe plate is provided with a cutout portion receiving the pry bar plate therein whereby the pry bar plate and the striker shoe plate are substantially flush with each other in a common plane when the pry bar plate is fully received in the cutout portion of the striker shoe plate. The striker shoe plate is also provided with a striker edge exposed in a direction opposite to the direction of extension of the pry bar plate for receiving hammer blows in order to simultaneously wedge the flush striker shoe and pry bar plates between a wall surface and a molding attached to the wall surface. The distal edges of the striker shoe plate and the pry bar plate may be tapered to assist wedged insertion of the plates between the wall surface and the molding. In addition, a nail claw V-notch may be provided in a distal edge of the pry bar plate for pulling nails.

The striker edge of the striker shoe plate may be provided in the form of a lip edge on the striker shoe plate that extends inwardly in the direction of extension of the pry bar, whereby the striker plate and striker edge thereof are easily formed of one piece in an inverted L-shape of metal plate.

The molding removal tool assembly of the present invention may also be used for other than removing molding, such as the removal of ceramic back splash, wall tile, broken ceramic floor tile and for light demolition work.

BRIEF DESCRIPTION OF THE DRAWINGS

Other objects and advantages appear hereinafter in the following description and claims. The accompanying drawings show, for the purpose exemplification, without limiting the scope of the invention or the appended claims, certain practical embodiments of the present invention wherein:

FIGS. 6A, 6B and 6C are perspective views sequentially illustrating the operation of the mold removal tool of the present invention wherein FIG. 6A illustrates initial positioning of the tool against a wall on an edge molding, FIG. 6B illustrates the tool of the present invention being driven downwardly with a hammer to a desired depth between the wall and the molding to be removed, and FIG. 6C illustrates the pry bar handle being rotated upwardly in order to separate the molding from the wall surface.

DETAILED DESCRIPTION OF THE DRAWINGS

Figure 1A:
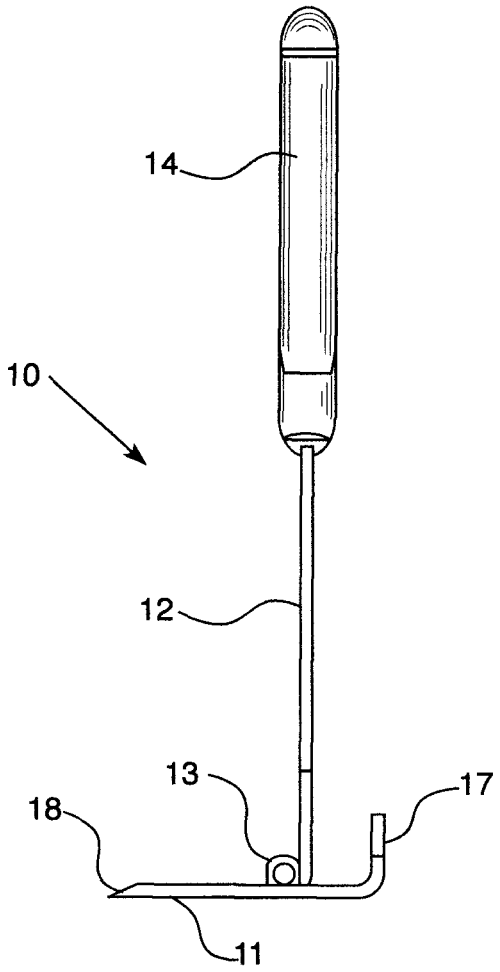
FIG. 1A is a view in right side elevation of the molding removal tool of the present invention.
Figure 1B:
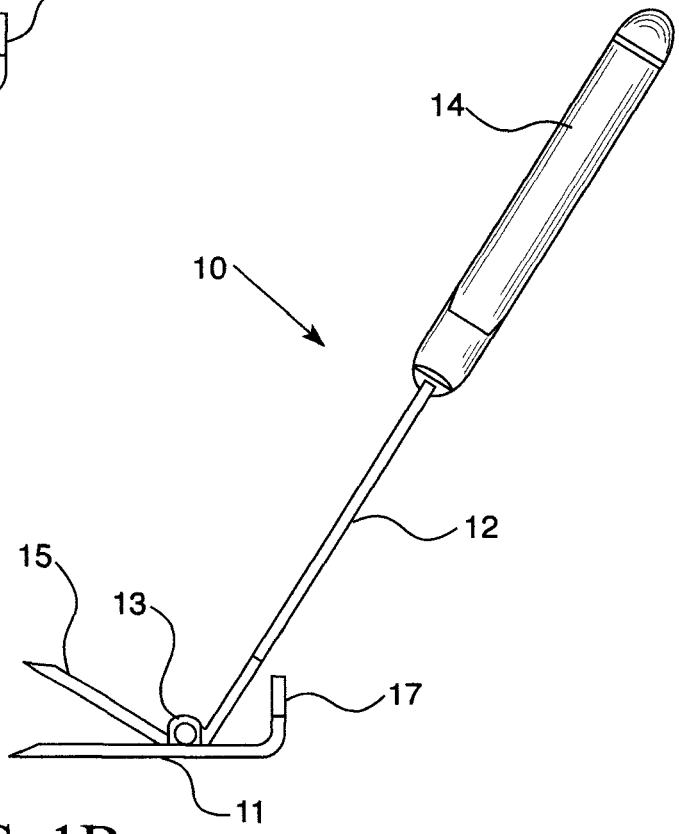
FIG. 1B illustrates the molding removal tool of FIG. 1A with the hinge mounted pry bar hinged to a leverage pry position relative to the striking shoe plate of the tool.
Figure 2A:
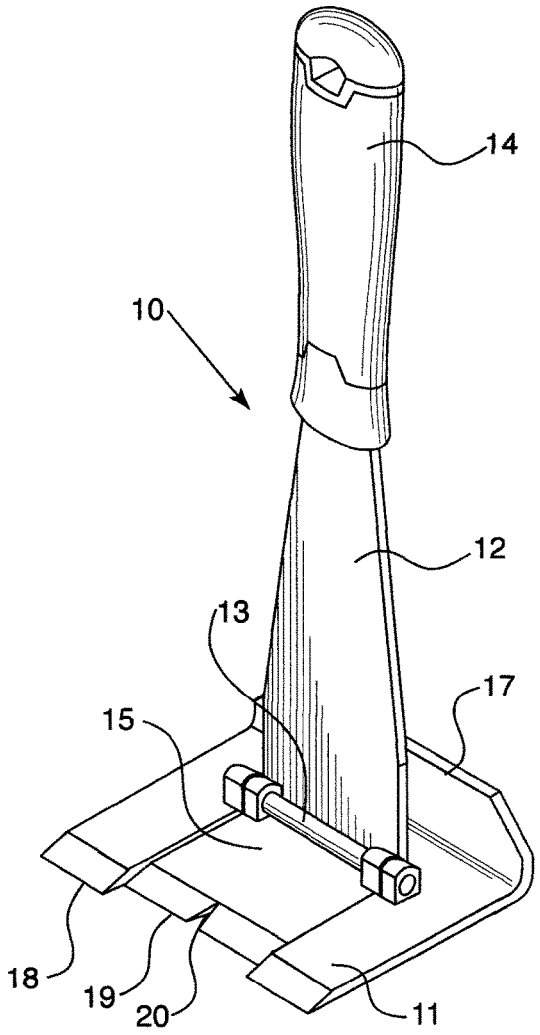
FIG. 2A is an isometric perspective view of the tool shown in FIG. 1A.
Figure 2B:
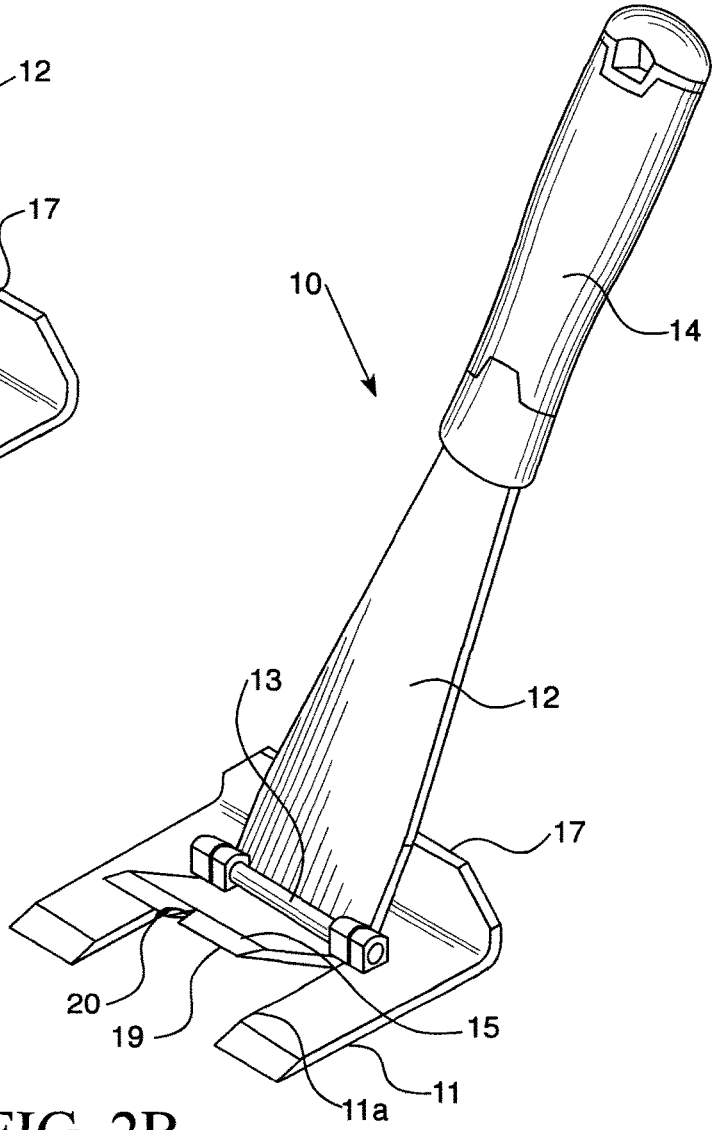
FIG. 2B is an isometric view from the front of the tool shown in FIG. 1B illustrating the pry bar as hinged relative to the striker shoe plate.
Figure 3:
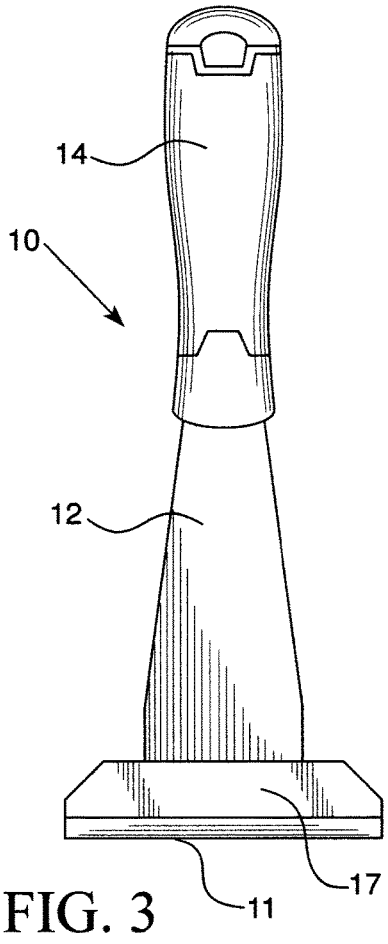
FIG. 3 is a view in back elevation of the tool shown in FIG. 1A.
Figure 4B:
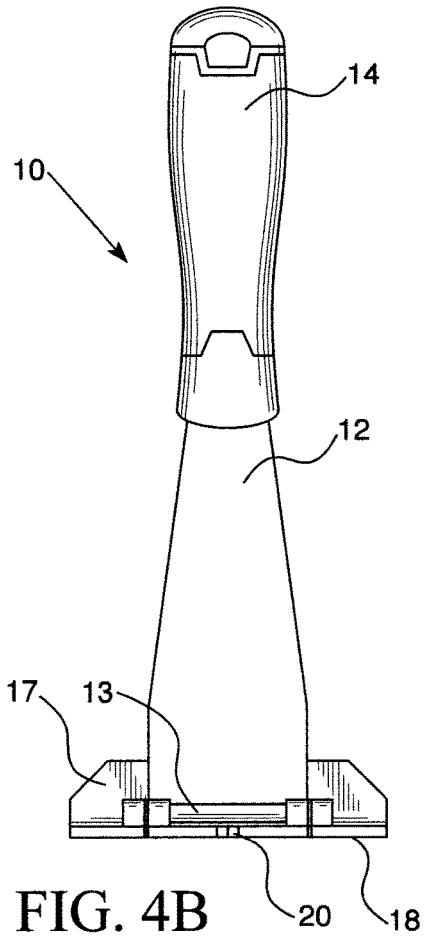
FIG. 4B is a view in front elevation of the tool shown in FIGS. 4A and 1A.
Figure 4A:
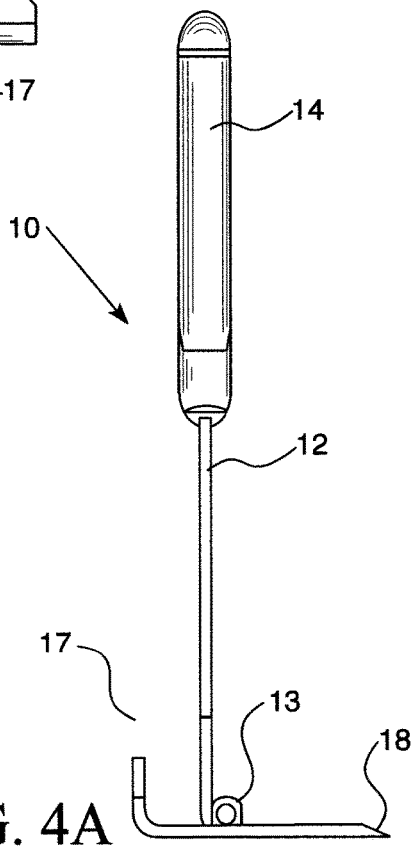
FIG. 4A is a left side view in elevation of the tool shown in FIG. 1A.
Figure 5:
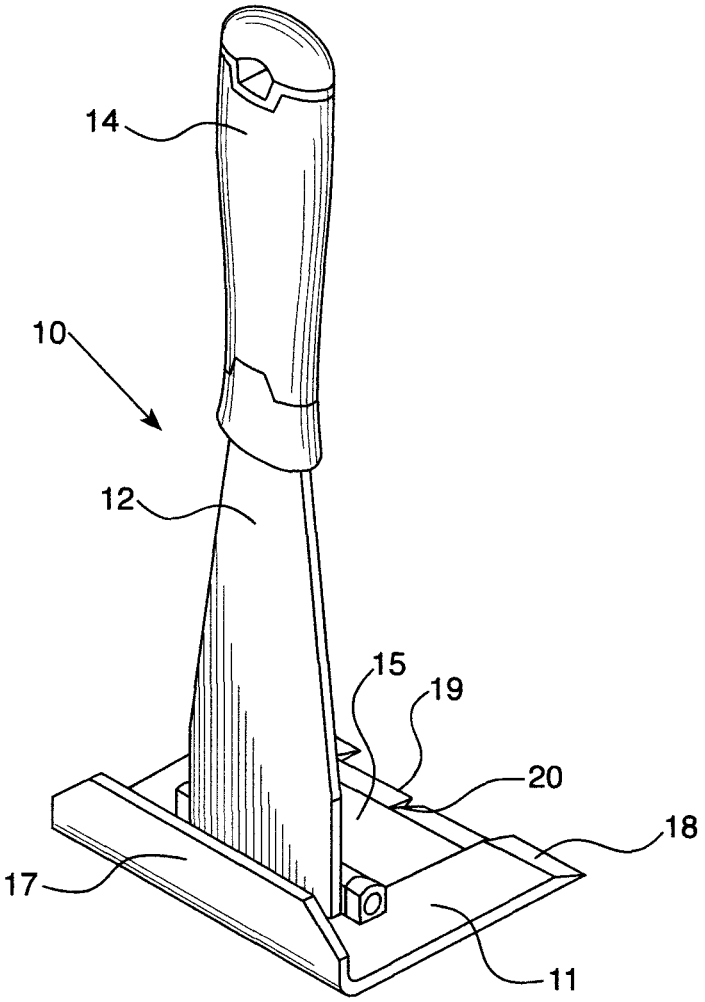
FIG. 5 shows the tool of FIG. 2A from the back or reverse side in a perspective view.
Figure 6A:
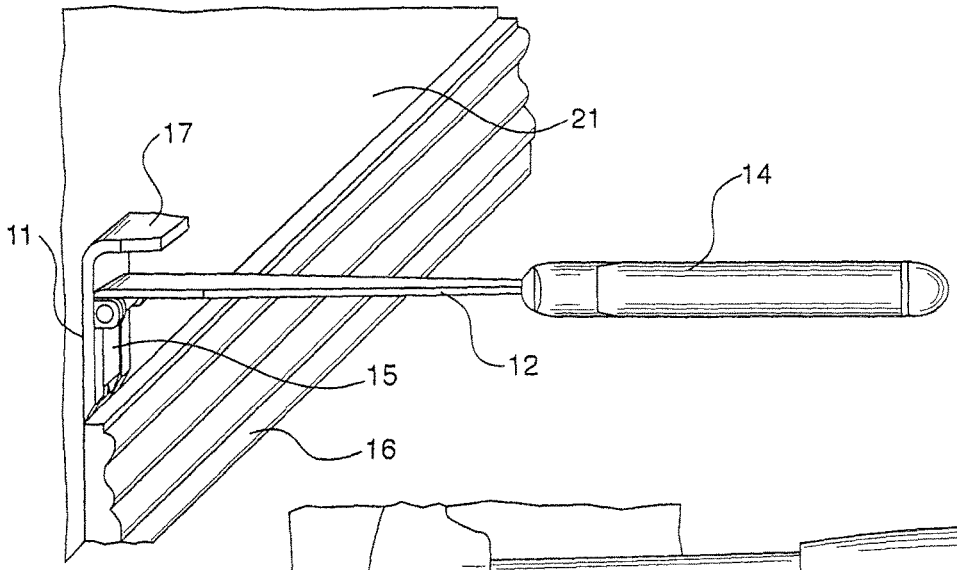
Figure 6B:
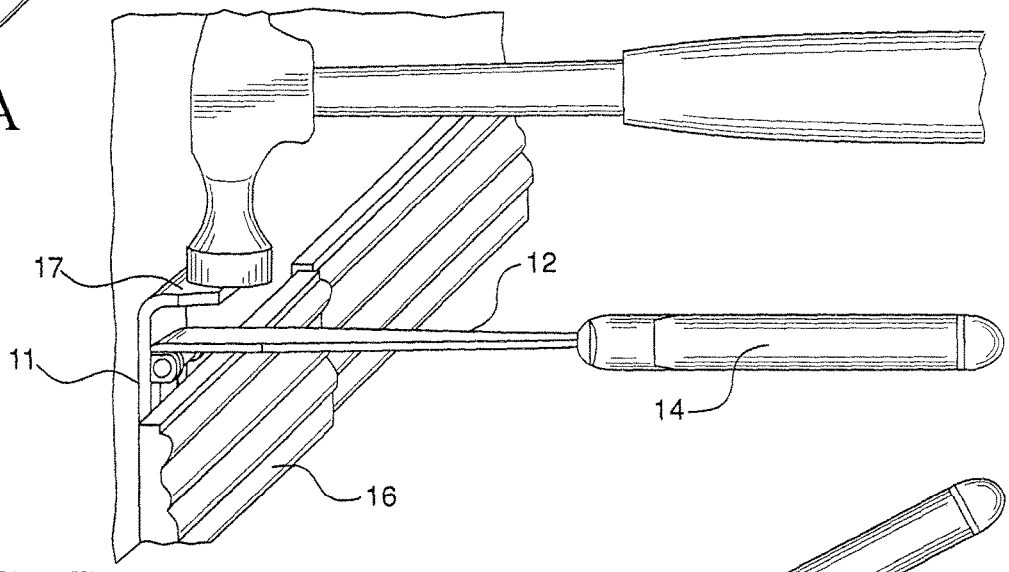
Figure 6C:
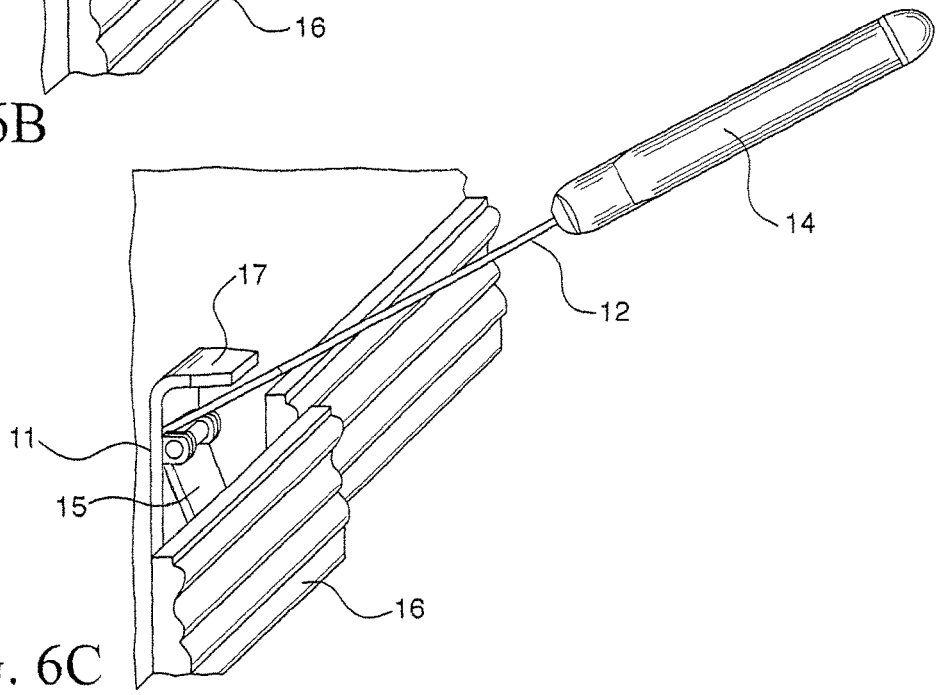

Referring to FIGS. 1 through 5, the molding removal tool assembly 10 is configured to assist a person in prying molding 16 off of a wall surface 21 as illustrated in FIGS. 6A, 6B and 6C without damaging the wall surface 21 or the molding 16.

With primary referenced first to FIGS. 1 through 5, the pry bar 12 is provided with handle 14 at the proximal end thereof and a pry bar plate 15 is secured to pry bar 12 at distal end thereof whereby the pry bar plate 15 extends from the pry bar 11 at an angle. In this illustration the angle is a right angle. A striker shoe plate 11 is comprised of a plate that is secured with a hinge 13 to the distal end of pry bar 12 at and aligned with an edge of hinge securement of the pry striker shoe plate 11 to pry bar 12. Striker shoe plate 11*a* is provided with a cutout portion 11*a* which receives the pry bar plate 15 therein whereby pry bar plate 15 and striker shoe plate 11 are substantially flush with each other in a common plane when the pry bar plate 15 is fully received in cutout portion 11*a* of striker shoe plate 11, as is best illustrated in FIG. 2A.

Striker shoe plate 11 is provided with a striker edge 17 exposed in a direction opposite to the direction of extension of the pry bar plate 15 for receiving hammer blows in order to simultaneously wedge the flush striker shoe plate 11 and the pry bar plate 15 between a wall surface 21 and molding 16 as illustrated in FIG. 6B.

Distal edges 18 and 19 of striker shoe plate 11 and pry bar plate 15 are tapered to assist wedged insertion of the plates between the wall surface 21 and the molding 16. In addition, a nail claw V-notch 20 is provided in the distal edge 19 of pry bar plate 15 for pulling nails.

In the drawings, the pry bar plate 15 extends from the pry bar 12 at a right angle. However, it should be understood that this angle may be other than a right angle, and may be slightly acute or obtuse.

The striker edge 17 consists of a lip edge on striker shoe plate 11 that extends inwardly in the direction of extension of pry bar 12 for receiving hammer blows as illustrated in FIG. 6B. This striker edge 17 extends from the striker shoe plate 15 at a right angle. However, it should be understood that the striker edge 17 may consist of a different configuration. What is important is that the striker lip edge 17 is capable of receiving hammer blows as illustrated in FIG. 6B.

The molding removal tool assembly 10 of the present invention is preferably constructed of a high strength, stamped steel in order to provide adequate strength and dependability of the tool and economical manufacturing.

Operation of the molding removal tool assembly 10 is best illustrated in FIGS. 6A, 6B and 6C, wherein sequential steps of application and operation of the tool are shown. In the first step illustrated in FIG. 6A, the bottom chisel edge 18 of striker plate 11 along with the bottom chisel edge 19 of pry bar plate 15 are placed flush against the wall on the upper edge of molding 16. Then the striker shoe 11, together with its attached pry bar 12, are simultaneously driven downwardly to a desired depth behind the molding 16 as illustrated in FIG. 6B by applying hammer blows against the upper right angle flange provided by striker edge 17 of striker shoe 11.

Once the tool assembly 10 is positioned as illustrated in the step of FIG. 6B, then pry bar handle 12 is rotated upwardly as illustrated in FIG. 6C to separate the molding 16 from the wall 21. Striker plate 11 eliminates any damage to wall 21 and the molding 16 is not damaged because it is pried away from wall 18 by pry bar plate 15 at a position well below the top or upper edge of molding 16 whereby pry forces are distributed evenly over an area of molding. The molding 16 is thus saved without damage for reuse and the wall 21 is undamaged.

I claim:

1. A molding removal tool assembly configured to assist a person in prying molding off of a wall surface without damaging the wall surface, said assembly comprising:

a pry bar with a handle at a proximal end thereof and a pry bar plate secured to said pry bar at a distal end thereof, said pry bar plate extending from said pry bar at an angle thereof;

a striker shoe having a striker shoe plate secured with a hinge to said pry bar at and aligned with an edge of hinge securement of said pry bar plate to said pry bar, said striker shoe plate having a cutout portion receiving said pry bar plate therein whereby said pry bar plate and said striker plate are substantially flush with each other in a common plane when said pry bar plate is fully received in said cutout portion of said striker shoe plate, said striker shoe plate having a striker edge exposed in a direction opposite to the direction of extension of said pry bar plate for receiving hammer blows in order to simultaneously wedge said flush striker shoe and pry bar plates between a wall surface and molding attached to the wall surface.

2. The molding removal tool assembly of claim 1, wherein distal edges of said striker shoe plate and said pry bar plate are tapered to assist wedged insertion of said plates between said wall surface and said molding.

3. The molding removal tool assembly of claim 1, including a nail claw V-notch in a distal edge of said pry bar plate for pulling nails.

4. The molding removal tool assembly of claim 1, wherein said pry bar plate extends from said pry bar at a right angle.

5. The molding removal tool assembly of claim 1, wherein said striker edge consists of a lip edge on said striker shoe plate that extends inwardly in the direction of extension of said pry bar.

6. The molding removal tool assembly of claim 5, wherein said striker lip edge extends from said striker shoe plate at a right angle.

* * * * *